US011214883B2

(12) United States Patent
Hori et al.

(10) Patent No.: US 11,214,883 B2
(45) Date of Patent: Jan. 4, 2022

(54) PLATING SOLUTION FOR COLORING, AND COLORING METHOD

(71) Applicant: JCU CORPORATION, Taito-ku (JP)

(72) Inventors: Masao Hori, Wixom, MI (US); Yasuo Hashimoto, Kawasaki (JP)

(73) Assignee: JCU CORPORATION, Taito-ku (JP)

( * ) Notice: Subject to any disclaimer, the term of this patent is extended or adjusted under 35 U.S.C. 154(b) by 0 days.

(21) Appl. No.: 16/478,910

(22) PCT Filed: Dec. 14, 2017

(86) PCT No.: PCT/JP2017/044834
§ 371 (c)(1),
(2) Date: Jul. 18, 2019

(87) PCT Pub. No.: WO2018/135197
PCT Pub. Date: Jul. 26, 2018

(65) Prior Publication Data

US 2019/0382910 A1 Dec. 19, 2019

(30) Foreign Application Priority Data

Jan. 18, 2017 (JP) ..... JP2017-006815

(51) Int. Cl.
*C25D 3/54* (2006.01)

(52) U.S. Cl.
CPC ..... *C25D 3/54* (2013.01)

(58) Field of Classification Search
CPC ..... C25D 3/54; C25D 3/56
See application file for complete search history.

(56) References Cited

U.S. PATENT DOCUMENTS

2010/0167087 A1* 7/2010 Wijenberg ..... C25D 3/562
428/680
2019/0230939 A1* 8/2019 Jiraschek ..... A47J 37/10

FOREIGN PATENT DOCUMENTS

| | | | | |
|---|---|---|---|---|
| CN | 101384754 | A | | 3/2009 |
| CN | 101724878 | A | * | 6/2010 |
| CN | 101724878 | A | | 6/2010 |
| CN | 102409374 | A | | 4/2012 |
| CN | 103726084 | A | | 4/2014 |
| JP | 58-27998 | A | | 2/1983 |
| JP | 7-292491 | A | | 11/1995 |
| JP | 9-302495 | A | | 11/1997 |

(Continued)

OTHER PUBLICATIONS

International Search Report dated Feb. 6, 2018 in PCT/JP2017/044834 filed on Dec. 14, 2017.

(Continued)

*Primary Examiner* — Louis J Rufo
(74) *Attorney, Agent, or Firm* — Oblon, McClelland, Maier & Neustadt, L.L.P.

(57) ABSTRACT

Provided is a technique for coloring without any problem with waste water or stability of color development or deposition. A plating solution for coloring characterized by containing a molybdate and a carboxylic acid having one or more carboxyl groups and one or more hydroxy groups and having two or more carbon atoms or a salt thereof, and having a pH of 4.5 to 7.5. A method for coloring a member to be plated characterized by electrolyzing the member to be plated as a cathode in this plating solution for coloring.

9 Claims, 2 Drawing Sheets

(56) References Cited

FOREIGN PATENT DOCUMENTS

| | | | |
|---|---|---|---|
| JP | 09302495 A | * | 11/1997 |
| JP | 2006-233279 A | | 9/2006 |

OTHER PUBLICATIONS

Combined Chinese Office Action and Search Report dated Jan. 19, 2021 in Patent Application No. 201780083664.0 (with partial English language translation and English translation of Category of Cited Documents), 14 pages.

Office Action dated Sep. 15, 2021, in Chinese Patent Application No. 201780083664.0, filed Dec. 14, 2017 (w/English-Language Translation).

Weihan, Zhu, et al., "New development of surface strengthening technology of metal materials", China North Industries Press, 1st edition, Sep. 1992, 5 pgs.(w/ English-language Translation).

* cited by examiner

PLATING SOLUTION FOR COLORING, AND COLORING METHOD

TECHNICAL FIELD

The present invention relates to a plating solution for coloring capable of coloring a member to be plated in a desired color, a coloring method using this solution, and the like.

BACKGROUND ART

It is known that coloring is performed for enhancing the decorativeness of a member having a metal surface. As a coloring method, a method for coloring the member by immersing it in a coloring agent, a method for coloring the member by thinly depositing another metal thereon, and other methods are known.

As a technique for coloring the member by thinly depositing another metal thereon, for example, a method in which electrolysis is performed using the member as a cathode in an aqueous solution containing a compound such as chromic acid, an inorganic cyanide, or a phosphate, and a molybdate, thereby forming a colored film on the surface of the member is known (PTL 1).

CITATION LIST

Patent Literature

PTL 1: JP-A-58-27998

SUMMARY OF INVENTION

Technical Problem

The above-mentioned method has, however, a problem with waste water, poor stability of color development or deposition, or the like caused by the use of a compound with a high environmental load such as chromic acid, an inorganic cyanide, or a phosphate.

Solution to Problem

In view of this, an object of the present invention is to provide a technique for coloring free from any problem with waste water or stability of color development or deposition.

The present inventors made intensive studies for achieving the above object, and as a result, they found that a plating solution, which uses a molybdate and a specific carboxylic acid or a salt thereof as a complexing agent for molybdenum, and is set to a specific pH, can achieve the object, and thus completed the present invention.

Specifically, the present invention is directed to a plating solution for coloring, characterized by containing a molybdate and a carboxylic acid having one or more carboxyl groups and one or more hydroxy groups and having two or more carbon atoms or a salt thereof, and having a pH of 4.5 to 7.5.

Further, the present invention is directed to a coloring method, characterized by electrolyzing a member to be plated as a cathode in the above-mentioned plating solution for coloring.

In addition, the present invention is directed to a colored product obtained by electrolyzing a member to be plated as a cathode in the above-mentioned plating solution for coloring.

Advantageous Effects of Invention

The plating solution for coloring of the present invention does not use a compound with a high environmental load such as chromic acid, an inorganic cyanide, or a phosphate, and therefore has no problem with waste water.

Further, the colored product of the present invention can maintain the metallic appearance of a substrate, and moreover also has high stability of color development or deposition.

DESCRIPTION OF EMBODIMENTS

Figure 1:
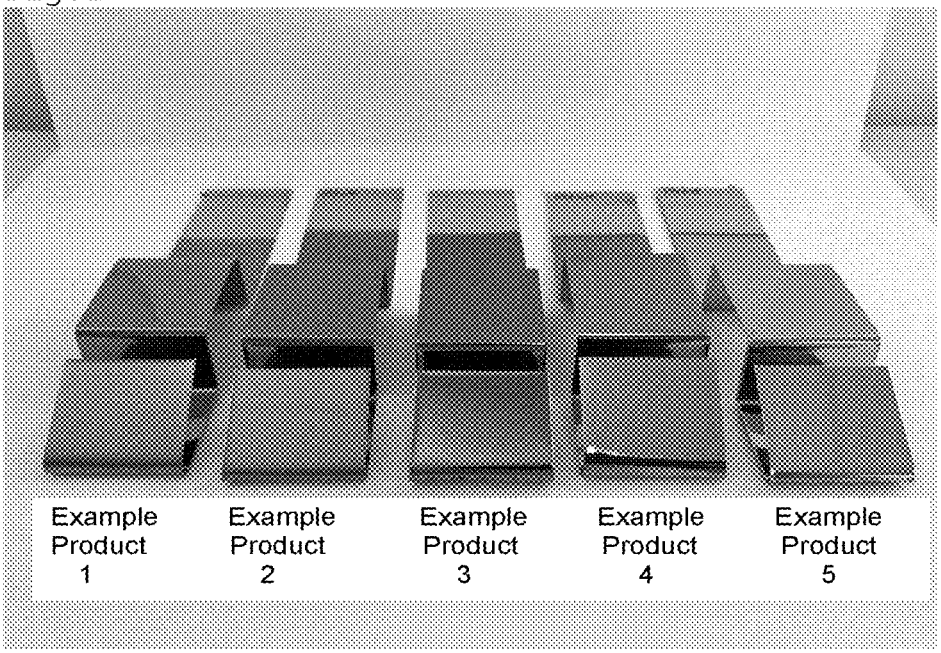
FIG. 1 is a view showing appearance after plating (Example Products 1 to 5 sequentially from the left).
Figure 2:
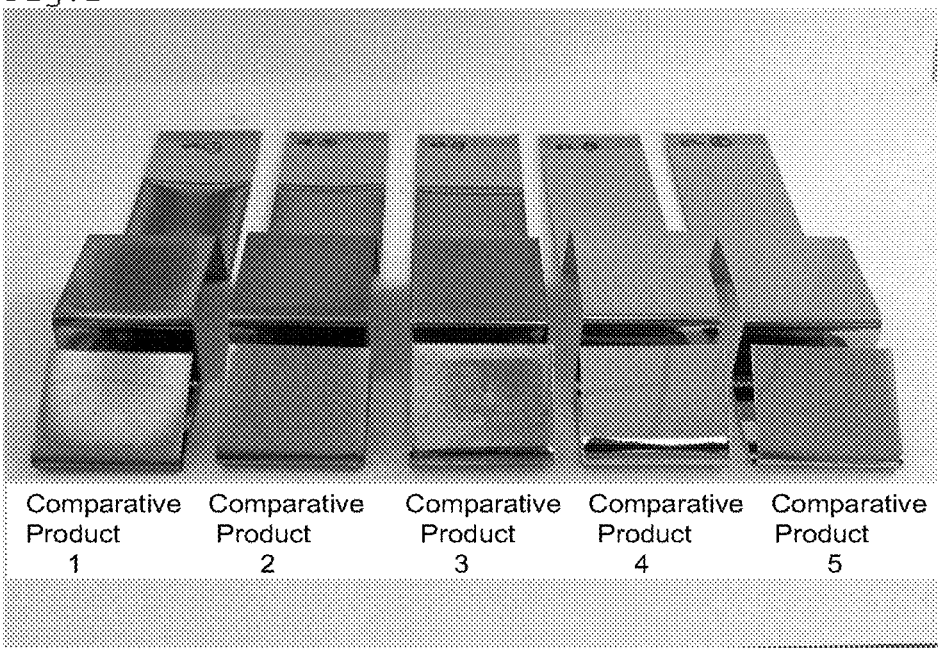
FIG. 2 is a view showing appearance after plating (Comparative Products 1 to 5 sequentially from the left).
Figure 3:
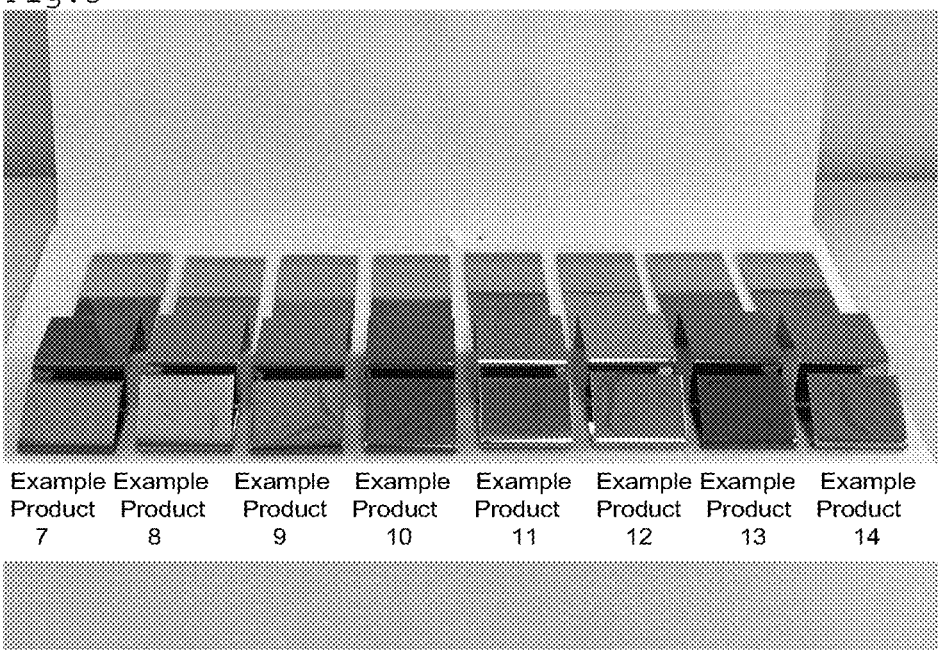
FIG. 3 is a view showing appearance after plating (Example Products 7 to 14 sequentially from the left).
Figure 4:
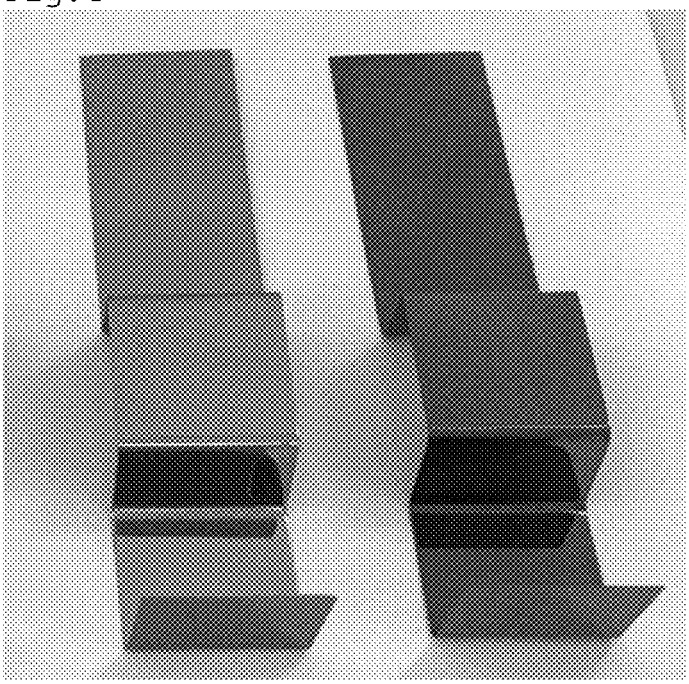
FIG. 4 is a view showing appearance after plating (Example Products 15 to 16 sequentially from the left).

The molybdate used in the plating solution for coloring of the present invention is not particularly limited, but examples thereof include alkali metal salts of molybdic acid such as sodium molybdate and potassium molybdate and ammonium salts of molybdic acid. Among these, sodium molybdate is preferred. Among these molybdates, one type or two or more types can be used. The content of the molybdate in the plating solution for coloring of the present invention is not particularly limited, but is from 0.1 to 50 g/L, preferably from 1 to 20 g/L.

The carboxylic acid having one or more carboxyl groups and one or more hydroxy groups and having two or more carbon atoms or a salt thereof used in the plating solution for coloring of the present invention is not particularly limited, but preferred examples thereof include carboxylic acids having 1 to 5 carboxyl groups and 1 to 8 hydroxy groups and having 2 to 10 carbon atoms, and more preferred examples thereof include carboxylic acids having 1 to 3 carboxyl groups and 1 to 6 hydroxy groups and having 2 to 8 carbon atoms, alkali metal salts such as sodium salts and potassium salts of the above-mentioned carboxylic acids, and ammonium salts of the above-mentioned carboxylic acids. Further, the carbon chain of the carboxylic acid may be branched or cyclic. Incidentally, in this description, a hydroxy group in the carboxyl group is not counted as a hydroxy group. Therefore, those containing only a carboxyl group such as acetic acid, oxalic acid, and EDTA are not included in the carboxylic acid having one or more carboxyl groups and one or more hydroxy groups and having two or more carbon atoms used in the plating solution for coloring of the present invention.

Specific examples of the carboxylic acid having one or more carboxyl groups and one or more hydroxy groups and having two or more carbon atoms or a salt thereof include citric acid, lactic acid, malic acid, tartaric acid, gluconic acid, and alkali metal salts such as sodium salts and potassium salts, and ammonium salts of these carboxylic acids. Among these, sodium gluconate is preferred.

In the plating solution for coloring of the present invention, one type or two or more types of the above-mentioned carboxylic acids having one or more carboxyl groups and one or more hydroxy groups and having two or more carbon atoms or salts thereof can be used. Further, the content of the carboxylic acid having one or more carboxyl groups and one or more hydroxy groups and having two or more carbon atoms or a salt thereof in the plating solution for coloring of the present invention is not particularly limited, but is from 10 to 100 g/L, preferably from 20 to 80 g/L.

In the plating solution for coloring of the present invention, further, a metal acid salt other than the molybdate may be incorporated. According to this, a plating time can be reduced. The metal acid salt other than the molybdate is not particularly limited, but examples thereof include alkali metal salts of metal acids such as tungstic acid, aluminic acid, titanic acid, and vanadic acid. Among these, tungstic acid, aluminic acid, and titanic acid are preferred. Among these metal acid salts other than the molybdate, one type or two or more types can be used. The content of the metal acid salt other than the molybdate in the plating solution for coloring of the present invention is not particularly limited, but is from 0.01 to 10 g/L, preferably from 0.05 to 5 g/L.

In addition, in the plating solution for coloring of the present invention, a surfactant or the like may be incorporated as long as the effect of the present invention is not impaired.

The pH of the plating solution for coloring of the present invention is from 4.5 to 7.5, preferably from 5.5 to 6.5. In the adjustment of the pH thereof, an acidic substance such as boric acid or sulfuric acid or an alkaline substance such as sodium hydroxide may be used.

Incidentally, the plating solution for coloring of the present invention only need to contain the above-mentioned components, and it is not necessary to incorporate chromic acid or a salt thereof, an inorganic cyanide, or a phosphate or a salt thereof having a high environmental load.

The plating solution for coloring of the present invention described above can be prepared by adding and mixing the above-mentioned components in water, followed by adjusting the pH of the resulting mixture.

Further, by electrolyzing a member to be plated as a cathode in the plating solution for coloring of the present invention, the member to be plated can be colored.

The member to be plated that is colored with the plating solution for coloring of the present invention is not particularly limited as long as it has a metal surface, and examples thereof include metal products made of stainless steel, chromium, brass, nickel, or the like, and resins such as ABS and PC/ABS previously plated such as copper-plated, nickel-plated, or chromium-plated.

The conditions of electrolyzing the member to be plated as a cathode in the plating solution for coloring of the present invention are not particularly limited, but, for example, electrolysis may be performed in the plating solution for coloring at 20 to 40° C. with a current density of 0.01 to 0.5 A/dm$^2$ using the member to be plated as a cathode and using carbon, iridium oxide, or the like as an anode for a time of about 1 to 180 minutes to obtain a desired color. After electrolysis, washing with water or the like may be performed.

By electrolyzing the member to be plated in the plating solution for coloring of the present invention, a product colored in brown, purple, bluish purple, blue, yellow, green, red, or the like can be obtained.

This colored product has a very thin plating thickness, and it is difficult in reality to perform an analysis other than an analysis of appearance color, and it is completely not practical to make a determination by other than the production method.

The colored product can be mainly used for ornaments, faucet metal fittings, automobile components, building materials, or the like.

EXAMPLES

Hereinafter, the present invention will be described in detail with reference to Examples; however, the invention is by no means limited to these Examples.

Example 1

Coloring Plating:

Plating solutions for coloring having a formulation shown in Table 1 were prepared by mixing respective components with water. In each of these plating solutions for coloring, coloring plating was performed using a member obtained by glossy nickel-plating a bent cathode made of brass as a cathode and using carbon as an anode under conditions shown in Table 1. The appearance color after plating was evaluated by visual observation, and also color uniformity and polarizability were evaluated by visual observation based on the following evaluation criteria. The results are shown in Table 2.

TABLE 1

| | Example Product 1 | Example Product 2 | Example Product 3 | Example Product 4 | Example Product 5 | Example Product 6 |
|---|---|---|---|---|---|---|
| Sodium molybdate (g/L) | 10 | 10 | 10 | 10 | 10 | 10 |
| Sodium gluconate (g/L) | 60 | 60 | 60 | 60 | 60 | 0 |
| Triammonium citrate (g/L) | 0 | 0 | 0 | 0 | 0 | 50 |
| Boric acid (g/L) | 30 | 30 | 30 | 30 | 30 | 30 |
| pH | 6.0 | 6.0 | 6.0 | 6.0 | 6.0 | 6.0 |
| Bath temperature (° C.) | 25 | 25 | 25 | 25 | 25 | 25 |
| Current density (A/dm$^2$) | 0.05 | 0.05 | 0.05 | 0.05 | 0.05 | 0.05 |
| Plating time (min) | 8.5 | 10 | 12.5 | 15 | 20 | 8.5 |

<Evaluation Criteria for Color Uniformity>

(Contents): (Evaluation)

A case where the entire surface has the same color: A

A case where the entire surface does not have the same color: B

<Evaluation Criteria for Polarizability>

(Contents): (Evaluation)

A case where there is no interference when the plated product is inclined at 45°: A A case where there is interference when the plated product is inclined at 45°: B

TABLE 2

| | Appearance color | Color uniformity | Polarizability |
|---|---|---|---|
| Example Product 1 | brown | A | A |
| Example Product 2 | purple | A | A |
| Example Product 3 | bluish purple | A | A |
| Example Product 4 | blue | A | A |
| Example Product 5 | yellow | A | A |
| Example Product 6 | brown | A | A |

From the above results, it was found that by using the plating solution for coloring of the present invention, the appearance color can be changed, and there are no problems with color uniformity and polarizability.

Comparative Example 1

Coloring Plating:

Coloring plating was performed in the same manner as in Example 1 except that plating solutions for coloring shown in Table 3 were used. Further, the appearance color after plating, color uniformity, and polarizability were evaluated in the same manner as in Example 1. The results are shown in Table 4.

TABLE 3

| | Comparative Product 1 | Comparative Product 2 | Comparative Product 3 | Comparative Product 4 | Comparative Product 5 |
|---|---|---|---|---|---|
| Sodium molybdate (g/L) | 10 | 10 | 10 | 10 | 10 |
| Sodium tungstate (g/L) | 2.7 | 2.7 | 2.7 | 2.7 | 2.7 |
| Ammonium acetate (g/L) | 0 | 25 | 50 | 0 | 0 |
| EDTA-4 Na (g/L) | 0 | 0 | 0 | 38 | 76 |
| Boric acid (g/L) | 30 | 30 | 30 | 30 | 30 |
| pH | 6.0 | 6.0 | 6.0 | 6.0 | 6.0 |
| Bath temperature (° C.) | 25 | 25 | 25 | 25 | 25 |
| Current density ($A/dm^2$) | 0.05 | 0.05 | 0.05 | 0.05 | 0.05 |
| Plating time (min) | 3 | 3 | 3 | 5 | 5 |

TABLE 4

| | Appearance color | Color uniformity | Polarizability | Others |
|---|---|---|---|---|
| Comparative Product 1 | interference color | B | B | |
| Comparative Product 2 | interference color | B | B | Film peeling |
| Comparative Product 3 | interference color | B | B | Film peeling |
| Comparative Product 4 | non-evaluable | | | No deposition |

TABLE 4-continued

| | Appearance color | Color uniformity | Polarizability | Others |
|---|---|---|---|---|
| Comparative Product 5 | non-evaluable | | | No deposition |

From the above results, it was found that even if a salt of a carboxylic acid is contained, when it is not a salt of a carboxylic acid having one or more carboxyl groups and one or more hydroxy groups and having two or more carbon atoms such as ammonium acetate or EDTA-4 Na, colored plating is not deposited or coloration cannot be uniformly made.

Example 2

Coloring Plating:

Coloring plating was performed in the same manner as in Example 1 except that plating solutions for coloring shown in Table 5 were used. Further, the appearance color after plating, color uniformity, and polarizability were evaluated in the same manner as in Example 1. The results are shown in Table 6.

TABLE 5

| | Example Product 7 | Example Product 8 | Example Product 9 | Example Product 10 | Example Product 11 | Example Product 12 | Example Product 13 | Example Product 14 |
|---|---|---|---|---|---|---|---|---|
| Sodium molybdate (g/L) | 10 | 10 | 10 | 10 | 10 | 10 | 10 | 10 |
| Sodium tungstate (g/L) | 2.7 | 2.7 | 2.7 | 2.7 | 2.7 | 2.7 | 0 | 0 |
| Sodium aluminate solution (ml/L) | 0 | 0 | 16 | 16 | 16 | 16 | 0 | 0 |
| Sodium titanate (g/L) | 0 | 0 | 0 | 0 | 0 | 0 | 1 | 1 |
| Sodium gluconate (g/L) | 60 | 60 | 60 | 60 | 60 | 60 | 60 | 60 |
| Triammonium citrate (g/L) | 0 | 0 | 0 | 0 | 0 | 0 | 0 | 0 |
| Boric acid (g/L) | 30 | 30 | 30 | 30 | 30 | 30 | 30 | 30 |
| pH | 6.0 | 6.0 | 6.0 | 6.0 | 6.0 | 6.0 | 6.0 | 6.0 |
| Bath temperature (° C.) | 25 | 25 | 25 | 25 | 25 | 25 | 25 | 25 |
| Current density ($A/dm^2$) | 0.05 | 0.05 | 0.05 | 0.05 | 0.05 | 0.05 | 0.05 | 0.05 |
| Plating time (min) | 8.5 | 12.5 | 1.5 | 2 | 3 | 5 | 5 | 8.5 |

TABLE 6

| | Appearance color | Color uniformity | Polarizability |
|---|---|---|---|
| Example Product 7 | purple | A | A |
| Example Product 8 | blue | A | A |
| Example Product 9 | brown | A | A |
| Example Product 10 | purple | A | A |
| Example Product 11 | blue | A | A |

TABLE 6-continued

| | Appearance color | Color uniformity | Polarizability |
|---|---|---|---|
| Example Product 12 | yellow | A | A |
| Example Product 13 | brown | A | A |
| Example Product 14 | blue | A | A |

From the above results, it was found that by combining a molybdate with a metal salt other than the molybdate in the plating solution for coloring of the present invention, the appearance color can be changed in a shorter time than in the case of using only the molybdate, and there are no problems with color uniformity and polarizability.

Comparative Example 2

Coloring Plating:

Coloring plating was attempted in the same manner except that 76 g/L of EDTA-4 Na was replaced with 35 g/L of sodium oxalate in the plating solution for coloring of Comparative Product 5 in Comparative Example 1; however, colored plating was not even deposited.

Example 3

Coloring Plating:

Plating solutions for coloring having a formulation shown in Table 7 were prepared by mixing respective components with water. In each of these plating solutions for coloring, coloring plating was performed using a member obtained by glossy nickel-plating a bent cathode made of brass as a cathode and using carbon as an anode under conditions shown in Table 7. The appearance color after plating, color uniformity, and polarizability were evaluated in the same manner as in Example 1. The results are shown in Table 8.

TABLE 7

| | Example Product 15 | Example Product 16 |
|---|---|---|
| Sodium molybdate (g/L) | 10 | 10 |
| Sodium gluconate (g/L) | 60 | 60 |
| Boric acid (g/L) | 30 | 30 |
| pH | 6.0 | 6.0 |
| Bath temperature (° C.) | 25 | 25 |
| Current density (A/dm$^2$) | 0.05 | 0.05 |
| Plating time (min) | 60 | 170 |

TABLE 8

| | Appearance color | Color uniformity | Polarizability |
|---|---|---|---|
| Example Product 15 | green | A | A |
| Example Product 16 | red | A | A |

By combining the results of Example 1 and Example 3, it was found that according to the present invention, colored products colored in brown, purple, bluish purple, blue, yellow, green, and red can be obtained.

INDUSTRIAL APPLICABILITY

The present invention can be utilized for producing a colored product having high decorativeness.

The invention claimed is:

1. A plating solution, consisting of:

a molybdate;

a carboxylic acid having one or more carboxyl groups and one or more hydroxy groups and having two or more carbon atoms or a salt thereof;

boric acid;

water; and optionally an additional transition metal acid salt other than the molybdate, wherein the additional transition metal acid salt is at least one selected from the group consisting of a tungstate, an aluminate, and a titanate;

wherein the plating solution has a pH of from 4.5 to 7.5.

2. The plating solution according to claim 1, wherein the carboxylic acid is sodium gluconate.

3. A method for coloring a member, the method comprising:

electrolyzing the member as a cathode in the plating solution according to claim 1.

4. The plating solution according to claim 1, wherein the molybdate is present in the plating solution at a concentration of 0.1-50 g/L.

5. The plating solution according to claim 1, wherein the molybdate is sodium molybdate.

6. The plating solution according to claim 1, wherein the carboxylic acid is present in the plating solution at a concentration of 10-100 g/L.

7. The plating solution according to claim 1, wherein the tungstate, if present, is sodium tungstate.

8. The plating solution according to claim 1, wherein the titanate, if present, is sodium titanate.

9. The plating solution according to claim 1, when the additional transition metal acid salt is present in the plating solution, a molar concentration of the molybdate is greater than that of the additional transition metal acid salt, wherein the additional transition metal acid salt is at least one selected from the group consisting of a tungstate, an aluminate, and a titanate.

* * * * *